United States Patent [19]

Houwink

[11] Patent Number: 4,809,515

[45] Date of Patent: Mar. 7, 1989

[54] OPEN CYCLE COOLED REFRIGERANT RECOVERY APPARATUS

[76] Inventor: John B. Houwink, 1419 W. Baker, Fullerton, Calif. 92633

[21] Appl. No.: 177,150

[22] Filed: Apr. 4, 1988

[51] Int. Cl.[4] ..... F25B 45/00

[52] U.S. Cl. ..... 62/149; 62/292

[58] Field of Search ..... 62/77, 149, 292, 470, 62/474, 475, 85, 217

[56] References Cited

U.S. PATENT DOCUMENTS

| | | | |
|---|---|---|---|
| 2,013,167 | 9/1935 | Musto | 62/217 X |
| 3,232,070 | 2/1966 | Sparano | 62/149 |
| 4,285,206 | 8/1981 | Koser | 62/126 |
| 4,364,236 | 12/1982 | Lower et al. | 62/84 X |
| 4,476,688 | 10/1984 | Goddard | 62/513 X |
| 4,539,817 | 9/1985 | Staggs et al. | 62/292 X |
| 4,646,527 | 3/1987 | Taylor | 62/292 X |

*Primary Examiner*—Harry B. Tanner

[57] ABSTRACT

Apparatus for recovery, storage, and recharging of refrigerant used in an outside air conditioning or refrigeration system which provides faster operation while ensuring complete recovery of refrigerant, using the minimum of components for maximum portability. This apparatus employs a compressor condenser assembly to utilize the stored refrigerant itself directed in an evaporating refrigerating cycle. The cooled stored refrigerant then contact condenses and cools the recovered refrigerant from the outside system. During recovery operation the open-cycle compressor condenser unit can also be used to recover refrigerant so as to increase the recovery rate and to allow a more complete recovery of refrigerant. In addition, the apparatus includes a recharging circuit which can discharge refrigerant to an outside system and a system to purify the stored refrigerant for reuse.

11 Claims, 1 Drawing Sheet

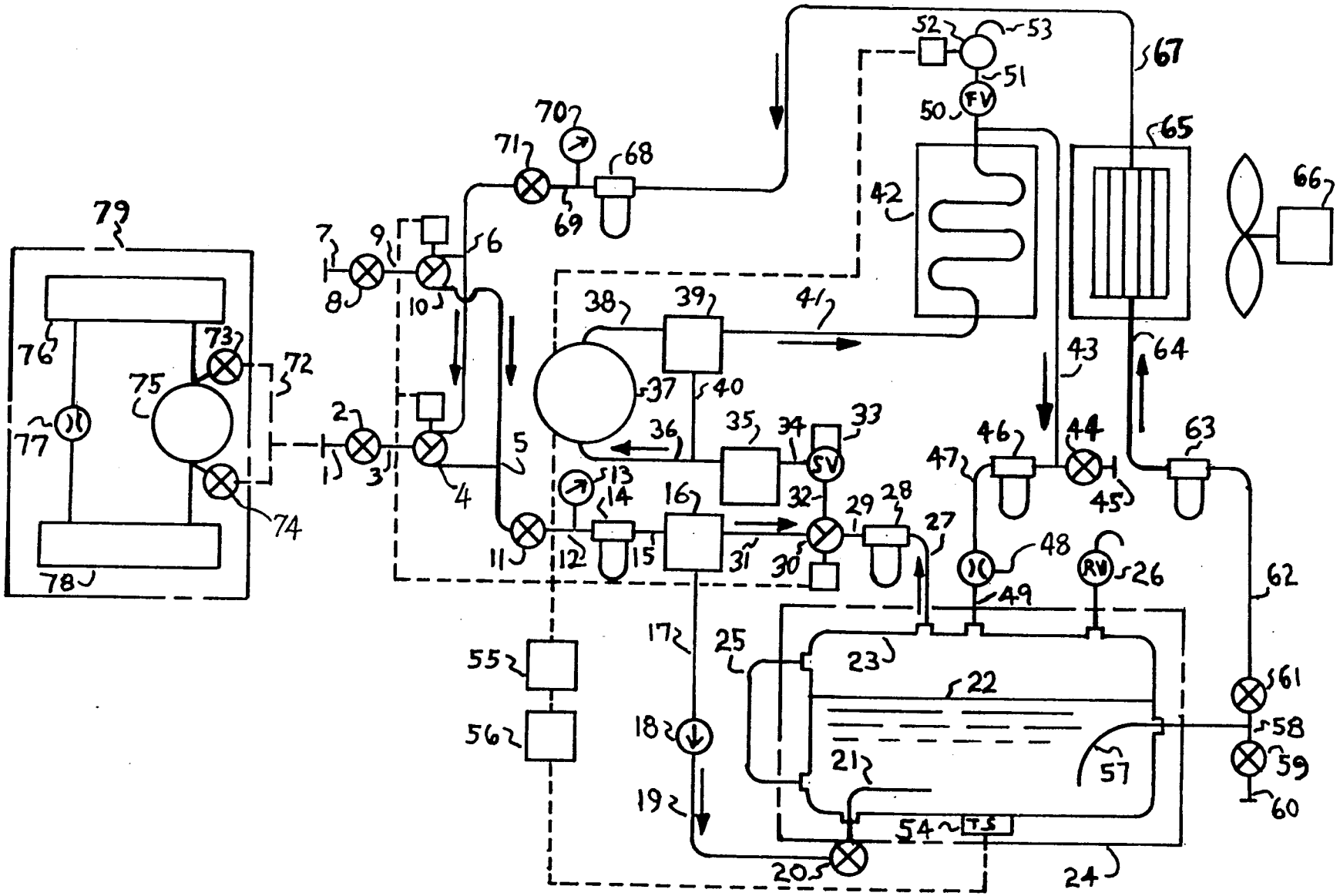
66
67
65
64
63
62
61
58
59
60
57
24
26
RV
45
44
43
48
49
46
47
22
27
28
29
23
21
54
TS
20
53
51
FV
52
50
42
33
SV
34
32
30
31
41
35
25
40
39
16
17
18
19
37
36
38
68
13
14
15
12
70
69
71
11
5
6
10
4
9
3
7
8
2
1
55
56
72
74
73
75
79
76
77
78

OPEN CYCLE COOLED REFRIGERANT RECOVERY APPARATUS

FIELD OF INVENTION

This apparatus relates to the field of recovery, storage, recharging and handling of refrigerants which is conducted during servicing of independent and separate refrigeration and air conditioning systems as used in various applications.

DESCRIPTION OF PRIOR ART

In the repair, servicing, or decommissioning of refrigeration systems, it is frequently necessary to discharge the refrigerant contained in the systems. This causes the refrigerant to enter the atmosphere which in the case of chloroflurocarbon (CFC) refrigerants has been found to be damaging to the ozone layer which protects the earth from ultraviolet radiation. In view of this, additional taxation or legislation restricting the discharging or use of CFC refrigerants is likely, which will discourage release of such refrigerants. If substitute refrigerants are developed and used, these are likely to be more expensive than present CFC refrigerants. Both of the above conditions will likely necessitate recovery and reuse of refrigerants in the future.

Various recovery devices have been developed in the past, ranging from simple chilled containers and externally refrigerated storage tanks to various direct compression and storage systems. These prior systems have disadvantages that limit their utility. In the externally refrigerated tank systems, heat transfer from the recovered refrigerant is limited by a heat exchanger system, thereby limiting the recovery rate. In addition, the minimum practical pressure allowed by the refrigerated storage tank systems is still high at practical temperatures. This excess pressure prevents complete recovery of refrigerant from the outside system and allows unnecessary loss of refrigerant to the atmosphere. The various compression and storage devices allow complete removal of refrigerant, however, they are slow, may have excessive peak power requirements, and are less portable due to the requirement of compressing and condensing all recovered refrigerant. Potential users of refrigerant recovery apparatus, such as appliance repairmen, automotive wrecking yards, and air conditioner repairmen, require an apparatus that is as compact as possible yet will recover the refrigerant in the minimum time possible. In addition to the disadvantages of the above systems, many previous systems required separate pumping or transferring components to allow use of drying, filtering, acid neutralizing, and air separation devices so that the reuse of the recovered refrigerant is possible.

It is the object of this invention to overcome the preceding objections with an apparatus that is simple in operation and compact in size and weight.

SUMMARY OF THE INVENTION

This open-cycle cooled refrigerant recovery apparatus is to provide the shortest refrigerant recovery time possible while also decreasing the peak power requirements, number of components, and weight of the apparatus, as well as allowing the complete recovery of refrigerant.

This recovery apparatus includes a cooled refrigerant storage tank as in the prior art. However, here the stored refrigerant is cooled evaporatively utilizing the stored refrigerant itself as the refrigerating medium by inducing it through the standard compression condenser unit mounted on the apparatus. In this manner the required minimum amount of stored refrigerant is normally kept cooled so as to allow rapid recovery of the outside refrigerant. This rapid recovery is caused by (1) the pressure differential existing due to the difference in saturation pressures of the outside ambient temperature refrigerant and the cooled, stored refrigerant in the storage reservoir, and (2) by the contact condensation of the recovered refrigerant vapor by the cooled, stored refrigerant utilizing a submerged inlet into the stored refrigerant. Additionally, since the open-cycle compressor and condenser system is common with the stored and/or recovered refrigerant when cooling the stored refrigerant, the same compressor condenser unit can be utilized easily and in a practical manner to recover additional refrigerant during the recovery operation, thereby decreasing the refrigerant recovery time. The compressor condenser unit also can be used to complete the recovery process by reducing the outside refrigeration system pressure well below the saturation pressure of the stored refrigerant, thereby allowing the maximum refrigerant recovery. Additionally, the system of open-cycle refrigeration of the stored refrigerant causes circulation of the stored and recovered refrigerant during normal cooling operation which allows utilization of simple filter, dryer, and other purification equipment. This feature eliminates the need for additional, auxiliary means of circulation such as pumps, piping, valves, etc. Additionally, the apparatus includes a recharging circuit that allows the user to recharge outside refrigeration systems from the apparatus. This circuit provides gaseous refrigerant which is required in the standard methods of recharging outside refrigeration systems.

Other objects and advantages of this apparatus will be obvious and apparent from the specifications following.

DESCRIPTION OF DRAWINGS

The FIGURE is a schematic diagram of the recovery apparatus connected to a typical outside refrigeration system as it would normally be attached to recover, store, purify, and/or recharge the refrigerant in the outside system.

DETAILED DESCRIPTION OF THE PREFERRED EMBODIMENT

In the FIGURE the apparatus is shown in schematic form connected to typical outside refrigeration system 79.

During normal operation or non-recovery operation, the apparatus remains in the cooling operation configuration. In this configuration as described below stored refrigerant 22 is kept in cooled and liquid form inside storage reservoir 23, which is covered with insulation 24 to prevent excessive heat gain. The stored refrigerant level must be maintained above a minimum amount since it is the cooled and liquid stored refrigerant itself that causes the majority of initial recovery operation due to saturation pressure differentials and contact condensation with the recovered refrigerant. In addition, stored refrigerant must be maintained below a maximum level so that excessive pressures or liquid carryover into the compressor cannot occur. The storage reservoir has level gage 25 to monitor stored refrigerant level and safety pressure relief valve 26 to prevent overpressurization.

Cooling of the stored refrigerant is effected by inducing the stored gaseous refrigerant from storage reservoir 23 via conduit 27 which causes evaporative cooling of stored liquid refrigerant directly through an open-cycle compressor circuit. Thus, no separate indirect heat exchanging means is required inside the storage tank to cool the stored refrigerant. From conduit 27, gaseous refrigerant flows through recirculation filter-dryer-acid neutralizer 28 and through conduit 29 to electrically operated three-way valve 30 which, during cooling operation, communicates conduit 29 with conduit 32 which leads to suction pressure control valve 33 which limits maximum suction pressure and compressor load during varying operating conditions. Refrigerant is conveyed through conduit 34 to accumulator 35 which separates and holds any entrained liquid refrigerant so as to prevent possible compressor damage. Flow continues via conduit 36 to suction of compressor 37, is compressed and discharged through conduit 38 to oil separator 39 which returns separated lubricant oil to the compressor via conduit 40 to ensure proper compressor lubrication. Refrigerant flow continues through conduit 41 to condensing heat exchanger 42 where the refrigerant is condensed and cooled. Flow continues through conduit 43, containing utility valve 44 and conduit 45, and to recirculation filter-dryer-acid neutralizer 46, then via conduit 47, through expansion valve 48 where the pressure of the refrigerant is decreased to that inside the storage reservoir and then conveyed via conduit 49 back to the storage reservoir 23. At the condenser outlet conduit 43 a standard type float valve 50 is connected which will trap and hold any air or other non-condensable gases mixed with the refrigerant. If excessive air accumulates it will be discharged via conduit 51 to electrically operated valve 52 and then to vent 53. Electrically operated valve 52 is controlled such that it operates with the compressor and time 55 to allow adequate air venting but minimizes gaseous refrigerant venting to the atmosphere. During cooling operation the compressor duty cycle is controlled by the thermostatic switch 54 which is set to maintain the liquid stored refrigerant temperature at the optimum point to provide adequately low temperature, and therefore low saturation pressure, of the stored refrigerant to allow proper recovery operation, and to minimize cooling power consumption. In addition, since the recovered and stored refrigerant may be contaminated, recirculation filter-dryer-acid neutralizers 28 and 46 allow continuing purification of stored refrigerant without additional equipment to provide circulation. This is advantageous since repeated passes of refrigerant through standard filter-dryer-acid neutralizers are normally required to ensure adequate purification of refrigerant.

During the actual recovery of refrigerant from an outside refrigeration system, the apparatus will be switched via control 56 by the user into the recovery operation configuration and the apparatus connected as in the FIGURE to outside system 79. The typical outside refrigeration system 79 shown contains service valves 73 and 74, compressor 75, condenser 76, expansion valve 77, and evaporator 78. The apparatus is connected to the service valves 73 and/or 74 with service hose 72 which conveys refrigerant to the transfer conduit 1 which leads to valve 2 and conduit 3 to an electrically operated three-way valve 4. This valve communicates alternately with inlet conduit 5, or outlet conduit 6. If required, a second outside refrigeration system can be connected to transfer conduit 7, through valve 8 and via conduit 9 to electrically operated three-way valve 10 and thereby also to inlet conduit 5 or outlet conduit 6. This manifolded arrangement, containing two or more transfer conduits and associated components, provides for simultaneous usage by two or more users. During recovery operation electrically operated three-way valves 4 and 10 are set via control 56 by the user to communicate conduit 3 with conduit 5 and conduit 9 to conduit 5. The recovered refrigerant is then conveyed via inlet conduit 5, to valve 11, via conduit 12, communicating with pressure gage 13 to inlet filter-dryer-acid neutralizer 14, through conduit 15 and into vapor-liquid separator 16, from which the predominately liquid component of the refrigerant exits through conduit 17. This component then passes through check valve 18, through conduit 19, through valve 20, through the submerged header inlet pipe 21 which is immersed in liquid, cooled refrigerant 22, thereby contact-condensing any vapors of recovered refrigerant and mixing the liquid component of recovered refrigerant with the stored cooled, liquid refrigerant. This flow of recovered refrigerant is due to the higher saturation pressure of the refrigerant in the outside system at ambient temperature and the lower saturation pressure of the cooled, stored refrigerant 22 in the storage reservoir 23. The rapid condensation of any recovered refrigerant vapor allows a high flow rate of recovered refrigerant.

Simultaneously, the predominately gaseous component of the recovered refrigerant exits liquid-vapor separator 16 via conduit 31 to electrically operated three-way valve 30 which communicates conduit 31 with conduit 32, when in the recovery configuration as set by control 56. From conduit 32 the recovered refrigerant is induced through the previously described compressor and condensesr circuit normally used for cooling the stored liquid refrigerant. The recovered refrigerant after being condensed and cooled in the previously described circuit is also deposited in the storage reservoir. This allows a faster recovery cycle and greatly increases the utility of apparatus. In addition, as the internal refrigerant pressure in the outside refrigeration system decreases below this internal pressure in the storage reservoir 23, check valve 18 closes and allows compressor 37 to complete the full recovery of refrigerant at low pressure, thereby ensuring maximum recovery of refrigerant in the minimum time.

So as to provide the recharging outside refrigeration system 79 using stored refrigerant 22 in storage reservoir 23, dip tube 57 allows liquid stored refrigerant to flow out of storage reservoir 23, through conduit 58 communicating with utility valve 59 and conduit 60, to valve 61, then through conduit 62, through outlet filter-dryer-acid neutralizer 63, through conduit 64 to gasifier 65. Gasifier 65 is utilized to distill liquid stored refrigerant to a gaseous state as required for recharge of outside refrigeration system 79. Large diameter, vertical exchanger tubing in gasifier 65 evaporates liquid refrigerant and limits liquid carryover. This allows some purification of recharge refrigerant to occur. Fan with motor 66 is used to provide both warming air for gasifier 65 and cooling air for condenser 42. From gasifier 65, gaseous refrigerant flows via conduit 67, through outlet filter-dryer-acid neutralizer 68, via conduit 69 communicating with pressure gage 70. Also, thereby to valve 71 then to conduit 6 and to electrically operated three-way valves 4 and 10, during recharging operation as controlled by user via control 56 three-way valves 4 and 10 communicate conduit 6 to conduits 3 and 9, thereby to valves 2 and 8 and to inlet conduits 1 and 7. Recharge refrigerant can thereby flow into outside refrigeration system 79 via service hose 72 from inlet conduits 1 and 7.

So as to allow regulation of the quantity of the stored refrigerant in the storage reservoir 23 by the user, utility valve 44 allows removal of liquid compressed refrigerant. Also, utility valve 59 is provided to allow addition or removal of stored refrigerant 22. These utility valves allow the user to remove excess stored refrigerant if overfilling develops during usage, or alternately, to add refrigerant to maintain a minimum required quantity of stored cooled refrigerant so as to ensure optimum recovery operation.

Realizing that various detail modifications and changes may be made to the above described specific apparatus, it is noted that the basic principles and characteristics shall not be limited by the specific description given herein. The scope of the invention is determined as claimed.

I claim:

1. An apparatus for recovery, storage and recharging of refrigerants as are used in an outside refrigeration system comprising:

A storage reservoir means including

A connecting and conveying means to allow the filling or draining of said storage reservoir means and connection of storage reservoir means to an outside refrigeration system, and A required minimum charge of cooled refrigerant of the type to be recovered, stored in the storage reservoir means, which is normally maintained in its low temperature state utilizing A compressing means inducing stored refrigerant vapor from the storage reservoir means through A connecting means such that the stored refrigerant vapor is itself used directly in a evaporative cooling cycle such that said refrigerant is the operating refrigerant, which is compressed and discharged to An externally cooled condensing means which rejects heat outside the system and condenses said refrigerant which flows through An expansion valving means to reduce the pressure of said refrigerant and return same to the storage reservoir means, such described direct refrigeration cycle thereby providing the quantity of cooled liquid refrigerant which is utilized for recovery of refrigerant from an outside system as described below utilizing A valving and conveying means to distribute the flow of recovered refrigerant from the outside refrigeration system into the storage reservoir means and utilizing the difference of saturation pressures due to the subambient temperature of the stored refrigerant and contact condensation of the recovered refrigerant vapors by the cooled stored refrigerant, so as to induce the flow of the recovered refrigerant into the storage reservoir.

2. The apparatus as claimed in claim 1, wherein the valving and conveying means to distribute the flow of recovered refrigerant comprises:

An additional valving and conveying means such that recovered refrigerant flow is additionally distributed to the suction of aforesaid compressing means normally used to cool the stored refrigerant, and thense to the storage reservoir means as a liquid; such that additional recovered refrigerant flow is caused.

3. The apparatus as claimed in claim 2, wherein the valving and conveying means to distribute the flow of recovered refrigerant comprises:

A separator means to divide the flow of recovered refrigerant into, firstly, a predominately liquid component flow, which is conveyed to the storage reservoir means and, secondly, into a predominately gaseous component flow which is conveyed into the suction of aforesaid compressing means.

4. The apparatus as claimed in claim 2, wherein the valving and conveying means to distribute the flow of recovered refrigerant comprises:

A check valve means installed in the valving and conveying means connecting to the storage reservoir means such that as the outside refrigeration system internal pressure decreases below the storage reservoir means internal pressure, said check valve closes and allows compressor means to lower the outside refrigeration system pressure below storage reservoir means internal pressure.

5. The apparatus as claimed in claim 1, wherein the valving and conveying means to distribute the flow of recovered refrigerant into the storage reservoir comprises:

A conveying means such that recovered liquid and vapor refrigerant are introduced into the storage reservoir means from a submerged inlet means such that submerged contact condensation of vapor occurs as well as intimate mixing of recovered and stored refrigerants.

6. The apparatus as claimed in claim 1, wherein an outside refrigeration system recharging means is provided comprising:

A conveying means from the storage reservoir means leading to

A gasifying means to gasify the conveyed refrigerant so that it may be conveyed via aforesaid conveying means into the outside refrigeration system.

7. The apparatus as described in claim 6, wherein a manifolding means is provided, which comprises:

A system of user controlled three-way valving means and

A connecting means arranged so that multiple users of the apparatus may recover or recharge refrigerant simultaneously.

8. The apparatus as claimed in claim 1, wherein the connection means from the storage reservoir and compressing means comprises:

A suction pressure regulation means installed in the connection means such that suction pressure is regulated during varying operating conditions.

9. The apparatus as claimed in claim 1, wherein a venting means is provided comprising:

An air purge type valving means communicating with the refrigerating circuit such that it will vent and remove any non-condensable gases in the refrigerating circuit.

10. The apparatus as claimed in claim 1, wherein an oil recovery means is included, comprising:

An oil separating means communicating with the refrigeration circuit such that any separated oil is returned to the compressor means via A conduit means which conveys oil to the compressor.

11. The apparatus as claimed in claim 1, wherein a recirculating purification means is included, comprising:

A system of filter-dryer-acid neutralizer units communicating with the refrigeration circuit so as to purify the circulated refrigerant during the normal cooling operation.

* * * * *